US009742118B2

(12) United States Patent
Goh et al.

(10) Patent No.: US 9,742,118 B2
(45) Date of Patent: Aug. 22, 2017

(54) ELECTRICAL CONNECTOR

(71) Applicant: Molex, LLC, Lisle, IL (US)

(72) Inventors: Hoon Chan Goh, Singapore (SG); Wee Teck Chua, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/813,803

(22) Filed: Jul. 30, 2015

(65) Prior Publication Data

US 2016/0190746 A1 Jun. 30, 2016

(30) Foreign Application Priority Data

Jul. 31, 2014 (CN) ..... 2014 1 0373053

(51) Int. Cl.

| | |
|---|---|
| ***H01R 24/00*** | (2011.01) |
| ***H01R 13/6471*** | (2011.01) |
| ***H01R 13/436*** | (2006.01) |
| *H01R 12/72* | (2011.01) |

(52) U.S. Cl.

CPC ..... *H01R 13/6471* (2013.01); *H01R 13/4367* (2013.01); *H01R 12/724* (2013.01)

(58) Field of Classification Search

CPC ..... H01R 13/646; H01R 13/6471; H01R 13/4367; H01R 12/724

USPC ..... 439/626, 630, 79

See application file for complete search history.

(56) References Cited

U.S. PATENT DOCUMENTS

| | | | | |
|---|---|---|---|---|
| 6,402,573 | B1 * | 6/2002 | Yeomans | H01R 13/4362 439/752 |
| 7,481,657 | B2 * | 1/2009 | Ng | H01R 13/516 439/637 |
| 8,353,726 | B2 | 1/2013 | Zhang et al. | |
| 2012/0238145 | A1 * | 9/2012 | Zhang | H01R 12/7005 439/660 |
| 2014/0162499 | A1 * | 6/2014 | Goh | H01R 13/6461 439/630 |
| 2016/0190746 | A1 * | 6/2016 | Goh | H01R 13/6471 439/626 |

FOREIGN PATENT DOCUMENTS

| | | |
|---|---|---|
| TW | 201424134 A | 6/2014 |

* cited by examiner

*Primary Examiner* — Abdullah Riyami
*Assistant Examiner* — Nader Alhawamdeh
(74) *Attorney, Agent, or Firm* — Jeffrey K. Jacobs

(57) ABSTRACT

An electrical connector comprises a body, a terminal positioning member provided at a rear end of the body and a first group of terminals mounted in terminal grooves of the body. The terminal positioning member comprises a first spacing rib and a second spacing rib. The first group of terminals comprises signal terminals and ground terminals. The signal terminals and the ground terminals each comprise a contact portion, a retaining portion and a tail portion, the retaining portion connecting the contact portion and the positioning portion, the positioning portion connecting the retaining portion and the tail portion. The first spacing rib extends between the positioning portions of the adjacent signal terminals, the second spacing rib extends between the positioning portion of the signal terminal and the positioning portion of the adjacent ground terminal and the first spacing rib is longer than the second spacing rib.

13 Claims, 8 Drawing Sheets

ELECTRICAL CONNECTOR

RELATED APPLICATIONS

This application claims priority to Chinese Application No. 201410373053.8 filed Jul. 31, 2014, which is incorporated herein by reference in its entirety.

TECHNICAL FIELD

The present disclosure relates to an electrical connector.

BACKGROUND

U.S. Pat. No. 8,353,726 discloses an electrical connector in which ground terminals and signal terminals of the electrical connector are spaced apart by an insulative material, thereby affecting transmission rate of signals and integrity of signals. Chinese patent application CN201220681334.6 discloses an electrical connector which comprises an insulative body, a plurality of ground terminals and a plurality of signal terminals, a part of portions which space contact portions of the signal terminals apart from contact portions of the ground terminals is removed. Although the part of the portions which space the contact portions of the signal terminals apart from the contact portions of the ground terminals is removed in the electrical connector disclosed in Chinese patent application CN201220681334.6, it can not meet requirements on higher transmission rate of the signals and higher integrity of the signals yet.

SUMMARY OF THE INVENTION

In view of the above problems, an object of the present disclosure is to correspondingly provide a new electrical connector. The present disclosure provides an electrical connector which comprises an elongated insulative body, a terminal positioning member and a first group of terminals. The elongated insulative body comprises a base portion and a mating portion extending forwards from the base portion. The base portion of the insulative body is provided with a plurality of terminal grooves extended to the mating portion. The terminal positioning member is provided to a rear end of the base portion of the insulative body. The terminal positioning member comprises a plurality of positioning grooves and a plurality of spacing ribs positioned between the positioning grooves. The first group of terminals is respectively mounted in the terminal grooves of the insulative body. The first group of terminals comprises at least a signal terminal pair formed by two adjacent signal terminals and a plurality of ground terminals respectively provided at two sides of the signal terminal pair. Each terminal of the first group of terminals comprises a first retaining portion retained in the corresponding terminal groove, a first contact portion extending from the first retaining portion and extending to the mating portion, a first positioning portion extending rearwards from the first retaining portion and a first tail portion. The first positioning portions of the signal terminals and the ground terminals are received in the corresponding positioning grooves of the terminal positioning member. In the spacing ribs related with the first group of terminals, the spacing rib positioned between the two first positioning portions of the signal terminal pair of the first group of terminals is longer, and the spacing rib positioned between the first positioning portion of the signal terminal and the first positioning portion of the adjacent ground terminal is shorter. The shorter spacing rib positioned between the first positioning portion of the signal terminal and the first positioning portion of the adjacent ground terminal makes side edges between of the first positioning portion of the signal terminal and the first positioning portion of the adjacent ground terminal have larger exposed areas directly facing each other relative to side edges between the two first positioning portions of the signal terminal pair.

In an embodiment, the first group of terminals comprises three ground terminals and two groups of signal terminal pair, the three ground terminals and the two groups of signal terminal pair are staggered side by side.

In an embodiment, the first retaining portion of each terminal of the first group of terminals comprises at least an aperture. In an embodiment, the electrical connector further comprises a second group of terminals; the second group of terminals comprises at least a signal terminal pair formed by two adjacent signal terminals and a plurality of ground terminals respectively provided at two sides of the signal terminal pair of the second group of terminals; each terminal of the second group of terminals comprises a second retaining portion retained in the corresponding terminal groove, a second contact portion extending from the second retaining portion and extending to the mating portion, a second positioning portion extending rearwards from the second retaining portion and a second tail portion, the second positioning portion of each terminal of the second group of terminals is received in the corresponding positioning groove of the terminal positioning member; in the spacing ribs related with the second group of terminals, the spacing ribs positioned between the two second positioning portions of the signal terminal pair of the second group of terminals are longer relative to the spacing ribs positioned between the second positioning portion of the signal terminal and the second positioning portion of the adjacent ground terminal of the second group of terminals.

In an embodiment, the second group of terminals comprises three ground terminals and two groups of signal terminal pair, the three ground terminals and the two groups of signal terminal pair of the second group of terminals are staggered side by side.

In an embodiment, the electrical connector further comprises a third group of terminals; each terminal of the third group of terminals comprises a third retaining portion retained in the corresponding terminal groove, a third contact portion extending from the third retaining portion and extending to the mating portion, a third positioning portion extending rearwards from the third retaining portion and a third tail portion, the third positioning portion of each terminal of the third group of terminals is received in the corresponding positioning groove of the terminal positioning member; the spacing ribs positioned between the third positioning portions of the terminals of the third group of terminals are identical in length.

In an embodiment, the third group of terminals comprises fifteen parallel terminals; in the fifteen terminals, the third contact portions of the two terminals further protrude rearwards than the other third contact portions of the third group of terminals.

In an embodiment, a height of the first positioning portion of the first group of terminals is different from a height of the second positioning portion of the second group of terminals and a height of the third positioning portion of the third group of terminals.

In an embodiment, the terminal positioning member comprises a raised portion; the first positioning portions of the first group of terminals are positioned on the raised portion.

In an embodiment, the first retaining portion of each terminal of the first group of terminals comprises at least an aperture; the second retaining portion of each terminal of the second group of terminals and the third retaining portion of each terminal of the third group of terminals each do not comprise an aperture.

In an embodiment, the terminal positioning member and the insulative body are separately manufactured; two sides of the terminal positioning member each are provided with a latching structure engaged on the insulative body.

In an embodiment, the latching structure of the terminal positioning member comprises a latching hook and a guiding bar, the insulative body is provided with a guiding groove corresponding to the guiding bar and a latching portion correspondingly engaged with the latching hook.

In an embodiment, the mating portion comprises a mating groove, the second group of terminals and the third group of terminals extend along an inner wall surface of the mating groove, the second group of terminals and the third group of terminals are spaced apart by a spacing region, the first group of terminals extend along another inner wall surface of the mating groove and face the spacing region.

DETAILED DESCRIPTION OF PREFERRED EMBODIMENTS

Figure 1:
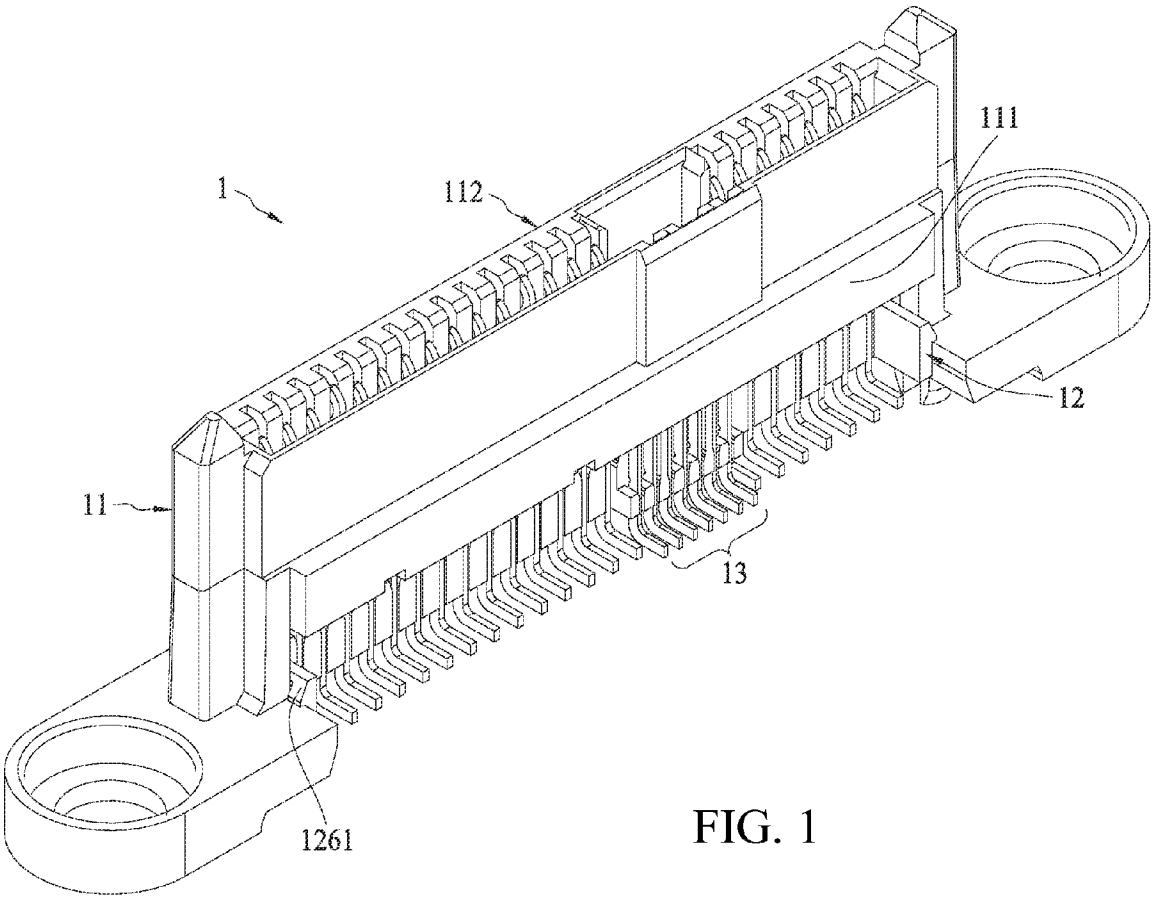
FIG. 1 is a schematic view illustrating an electrical connector of an embodiment of the present disclosure.

As can be appreciated from a review of the application, the effects of the present disclosure are as follows: the two signal terminals of the signal terminal pair of the first group of terminals are spaced apart by the longer spacing rib, the signal terminal and the ground terminal of the first group of terminals are spaced apart by the shorter spacing rib, therefore the side edges positioned between the signal terminal and the adjacent ground terminal have larger exposed areas directly facing each other relative to the side edges positioned the two signal terminals, thereby decreasing the signal crosstalk due to coupling between the terminals of the group of terminals, thus facilitating the high-rate transmission of the signals and improved signal integrity.

Referring to FIG. 1 to FIG. 5, an electrical connector 1 comprises an elongated insulative body 11, a terminal positioning member 12 and at least a first group of terminals 13. The at least first group of terminals 13 comprises a plurality of terminals. The at least first group of terminals 13 may be assembled on the elongated insulative body 11 and the terminal positioning member 12.

The insulative body 11 comprises a base portion 111, a mating portion 112 and a plurality of terminal grooves 113. The mating portion 112 extends forwards from the base portion 111. The mating portion 112 is used to mate with a mating device. The terminal grooves 113 are provided to the base portion 111 of the insulative body 11. The terminal grooves 113 extend to the mating portion 112.

Figure 4:
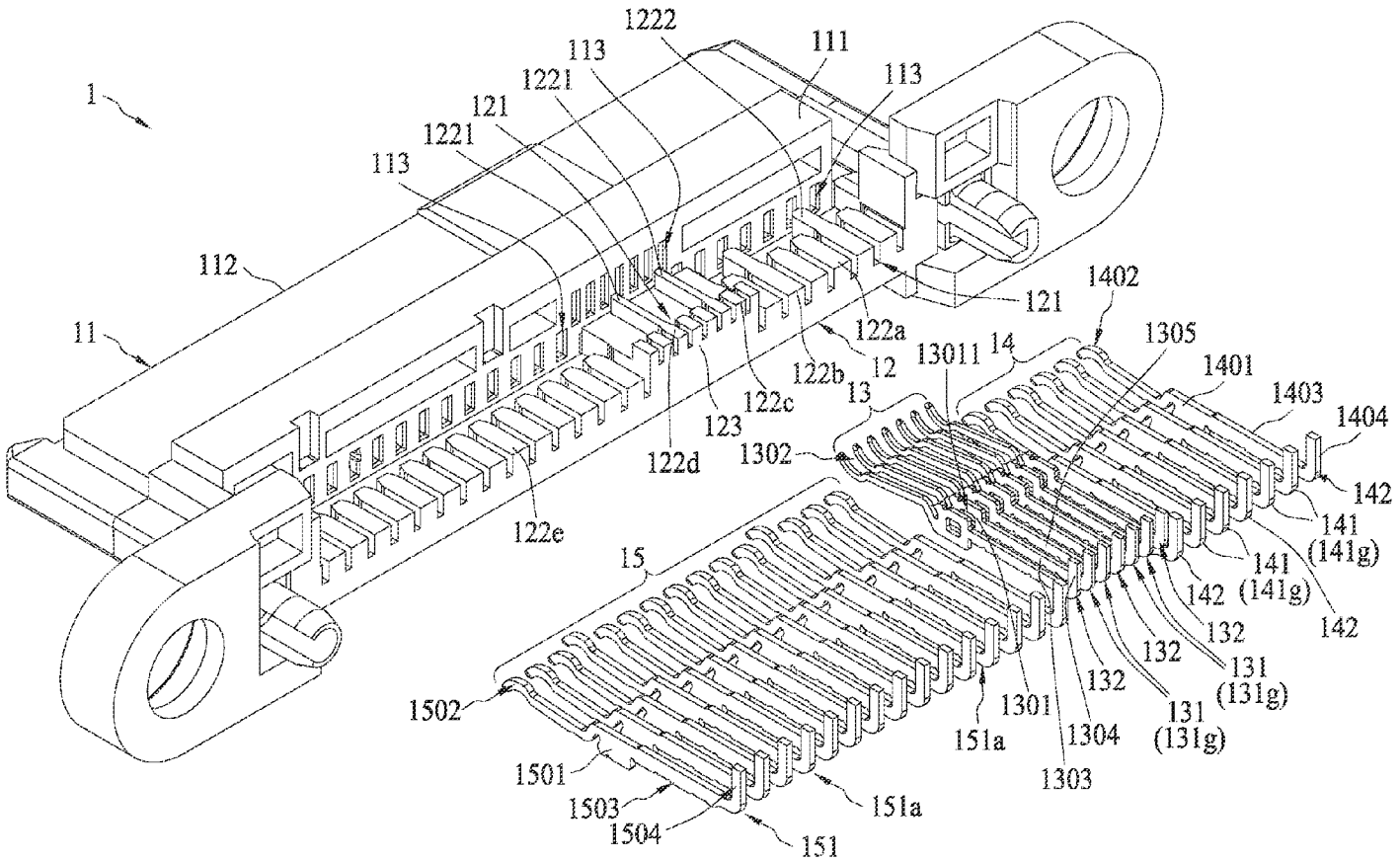
FIG. 4 is a schematic view of the embodiment of the present disclosure illustrating an elongated insulative body and a terminal positioning member are assembled and separated terminals.
Figure 5:
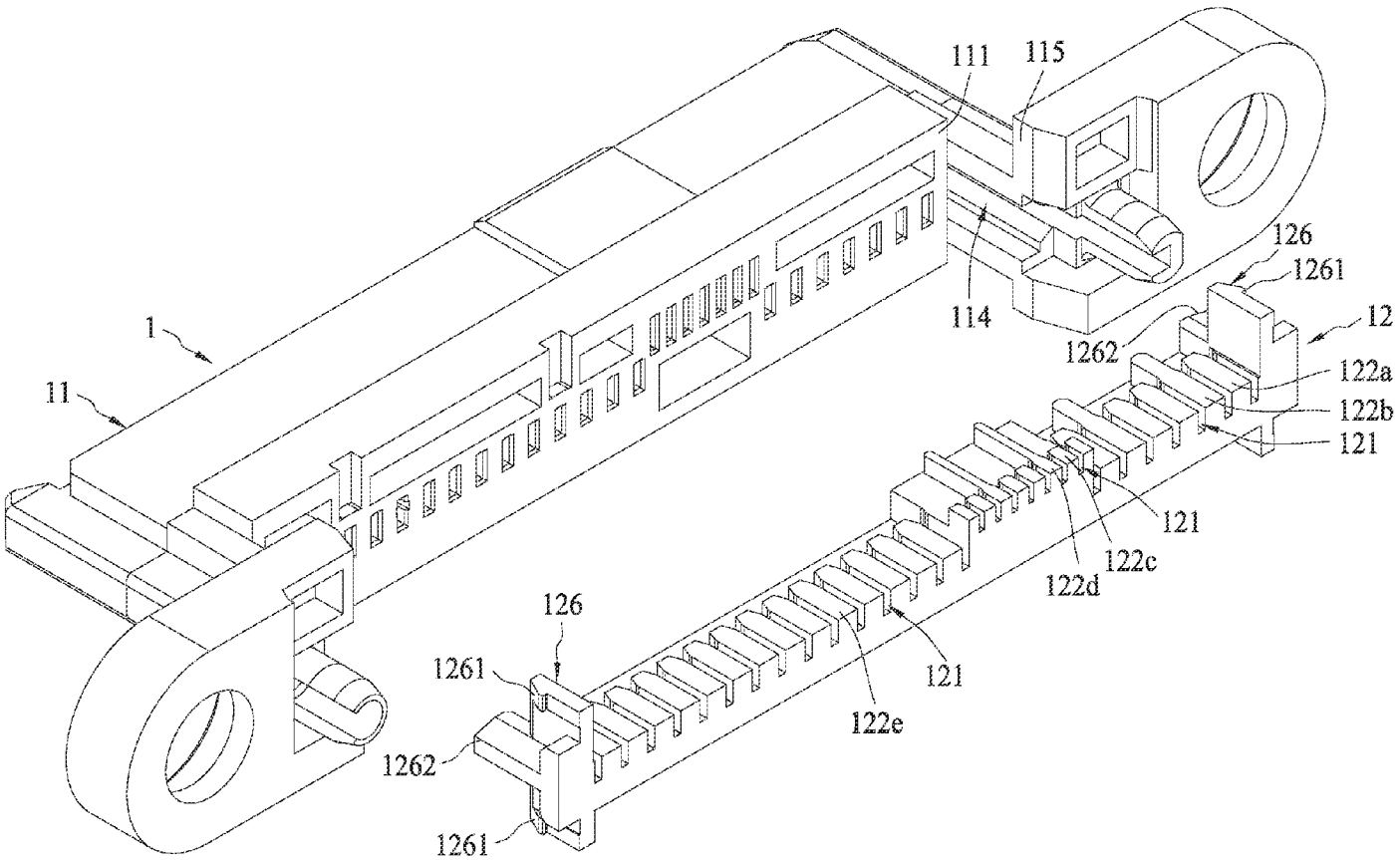
FIG. 5 is a schematic view illustrating the insulative body and the terminal positioning member of the embodiment of the present disclosure.

Referring to FIG. 4 and FIG. 5, the terminal positioning member 12 is provided at a rear end of the base portion 111 of the insulative body 11. The terminal positioning member 12 comprises a plurality of positioning grooves 121 and a plurality of spacing ribs 122*a*, 122*b*, 122*c*, 122*d* and 122*e*, the positioning grooves 121 are positioned between the spacing ribs 122*a*, 122*b*, 122*c*, 122*d* and 122*e*. Each terminal of the first group of terminals 13 may extend and pass through the corresponding positioning groove 121 to be interposed between the corresponding two spacing ribs 122*c* and 122*d*.

Referring to FIG. 5, in some embodiments, the terminal positioning member 12 and the insulative body 11 are integrally formed. In some embodiments, the terminal positioning member 1 and the insulative body 11 are separately manufactured. Two sides of the terminal positioning member 12 each are provided with a latching structure 126, the latching structure 126 may be engaged with the insulative body 11. In some embodiments, each latching structure 126 comprises a latching hook 1261 and a guiding bar 1262. Correspondingly, the insulative body 11 comprises a guiding groove 114 and a latching portion 115. When the terminal positioning member 12 is assembled to the insulative body 11, the guiding bar 1262 may move in the guiding groove 114 and may be guided by the guiding groove 114. After the terminal positioning member 12 is assembled to the insulative body 11, the latching hook 1261 may hook the latching portion 115 to make the terminal positioning member 12 fixed to the insulative body 11.

Figure 3:
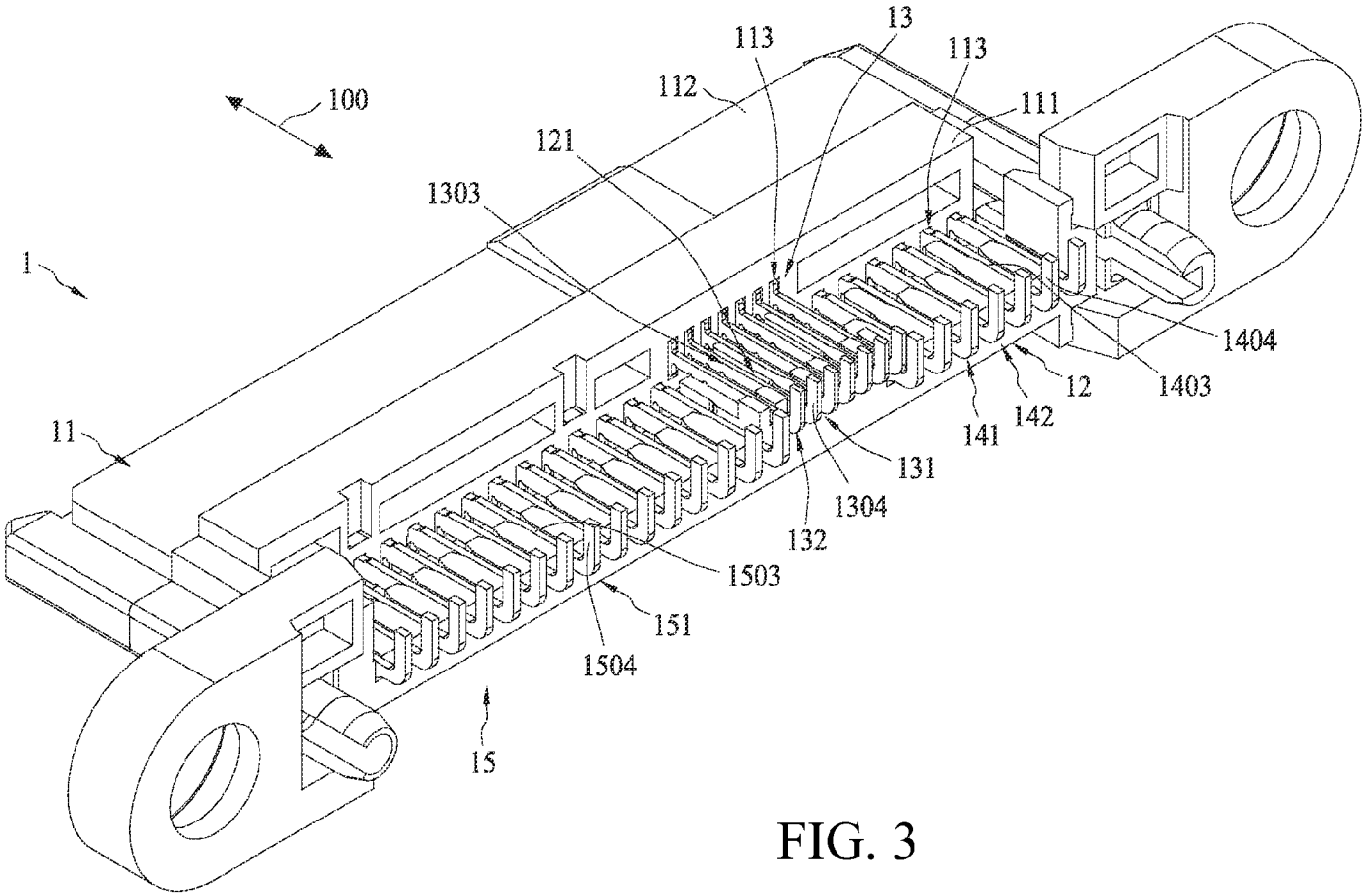
FIG. 3 is another schematic view illustrating the electrical connector of the embodiment of the present disclosure.

Referring to FIG. 3 and FIG. 4, the first group of terminals 13 is mounted in the corresponding terminal grooves 113 of the insulative body 11. The first group of terminals 13 comprises at least two adjacent signal terminals 131. The two adjacent signal terminals 131 may form a signal terminal pair 131*g*. The first group of terminals 13 may further comprise at least two ground terminals 132, the two ground terminals 132 are respectively positioned at two sides of the signal terminal pair 131*g*.

Figure 6:
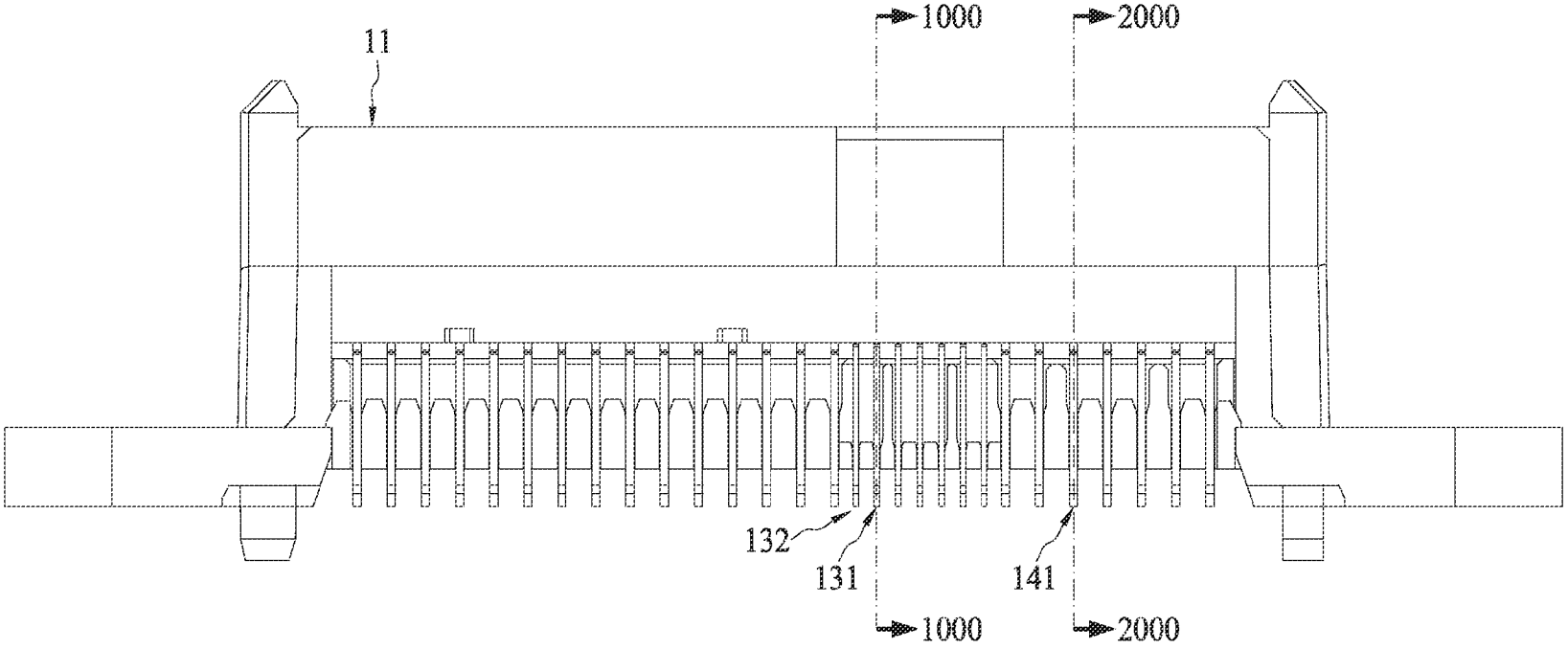
FIG. 6 is another schematic view illustrating the electrical connector of the embodiment of the present disclosure.
Figure 7:
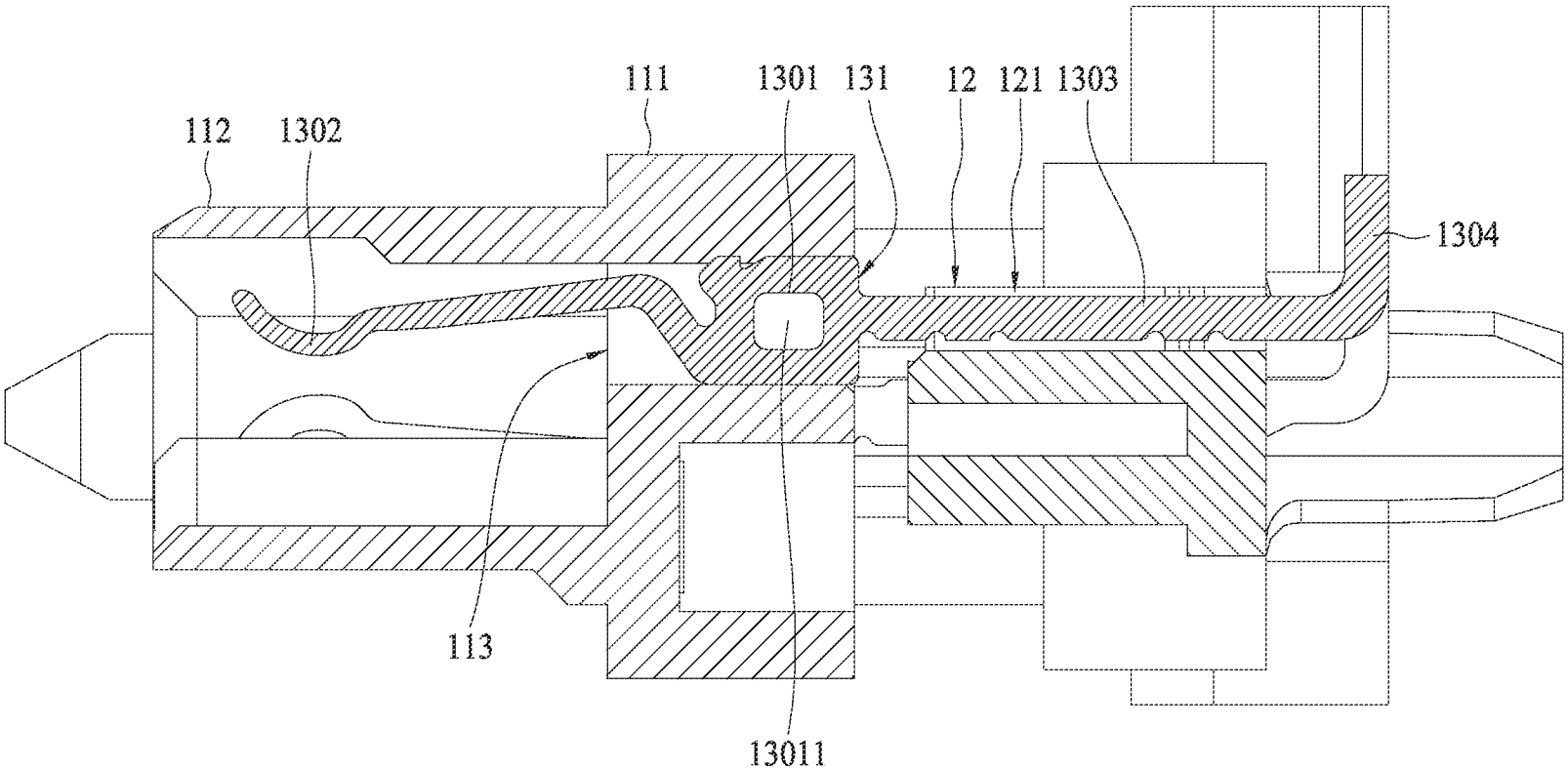
FIG. 7 is a cross sectional view taken along a line 1000-1000 of FIG. 6.

Each terminal (131 or 132) of the first group of terminals 13 comprises a first retaining portion 1301, a first contact portion 1302, a first positioning portion 1303 and a first tail portion 1304. Referring to FIG. 6 and FIG. 7, in each terminal (131 or 132), the first retaining portion 1301 may be retained in the corresponding terminal groove 113, the first contact portion 1302 may extend from the first retaining portion 1301 and extend to the mating portion 112, the first positioning portion 1303 may extend rearwards from the first retaining portion 1301 and be received in the corresponding positioning groove 121 of the terminal positioning member 12, the first tail portion 1304 may be connected to the first positioning portion 1303.

Referring to FIG. 4, the spacing rib 122*d* extends between the two first positioning portions 1303 of the signal terminal pair 131*g* of the first group of terminals 13, the spacing rib 122*c* extends between the first positioning portion 1303 of the signal terminal 131 and the first positioning portion 1303 of the adjacent ground terminal 132, the spacing rib 122*d* is longer than the spacing rib 122*c*; or in the spacing ribs 122*c* and 122*d* related with the first group of terminals 13, the spacing rib 122*d* is longer, and the spacing rib 122*c* is shorter. Because the spacing rib 122*c* positioned between the first positioning portion 1303 of the signal terminal 131 and the first positioning portion 1303 of the adjacent ground terminal 132 is shorter, side edges 1305 positioned between the first positioning portion 1303 of the signal terminal 131 and the first positioning portion 1303 of the adjacent ground terminal 132 have larger exposed areas directly facing each other relative to side edges 1305 positioned between the two first positioning portions 1303 of the signal terminal pair 131*g*, and the design with the larger exposed areas directly facing each other may decrease the signal crosstalk due to coupling between the terminals (131 or 132) of the first group of terminals 13 thereby facilitating the high-rate transmission of the signals and the integrity of the signals, and meeting the requirements on lowering near-end crosstalk of the electrical connector 1 when the electrical connector 1 is under high-rate transmission.

In some embodiments, the first retaining portion 1301 of each terminal (131 or 132) of the first group of terminals 13 comprises at least an aperture 13011, as shown in FIG. 7. The aperture 13011 may decrease coupling capacitance of the first group of terminals 13, and improve characteristic impedance in the time domain reflectometry of the electrical connector 1.

Referring to FIG. 4, in some embodiments, the first group of terminals 13 comprises seven terminals (131 and 132) which are divided into three ground terminals 132 and two groups of signal terminal pairs 131*g*. The seven terminals (131 and 132) are arranged side by side. The three ground terminals 132 may be respectively positioned between the two groups of signal terminal pairs 131*g* and at two outer sides of the two groups of signal terminal pairs 131*g*; or the three ground terminals 132 and the two groups of signal terminal pairs 131*g* are staggered side by side, thereby making the two sides of each signal terminal pair 131*g* arranged with the ground terminal 132.

In some embodiments, a width of a longer portion 1221 of the spacing rib 122*d* relative to the spacing rib 122*c* is smaller than a width of the spacing rib 122*c* or a width of other portions of the spacing rib 122*d*.

Figure 8:
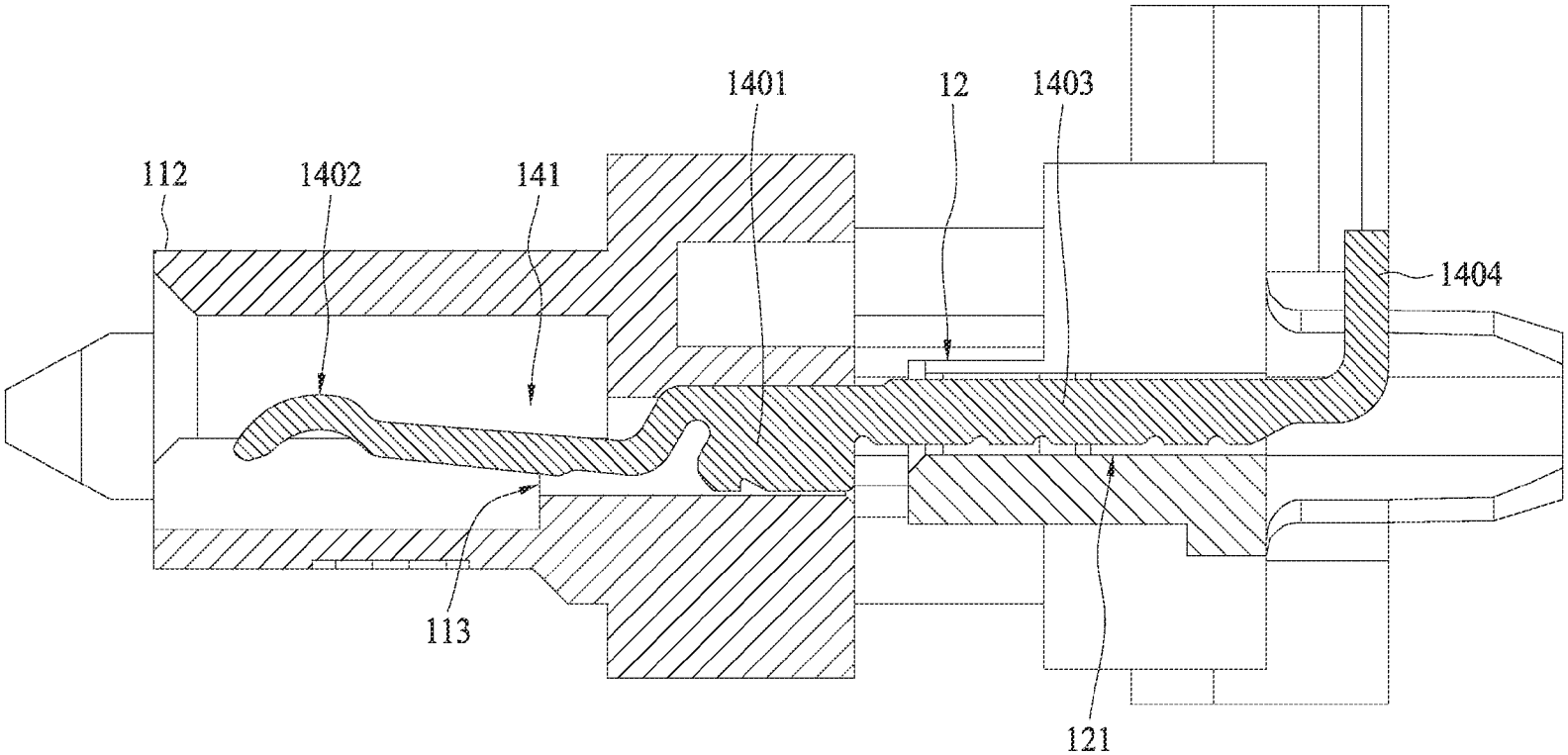
FIG. 8 is a cross sectional view taken along a line 2000-2000 of FIG. 6.

Referring to FIG. 4, the electrical connector 1 comprises a second group of terminals 14. The second group of terminals 14 may comprise at least two adjacent signal terminals 141 and two ground terminals 142. The two adjacent signal terminals 141 may form a signal terminal pair 141*g*, the two ground terminals 142 may be respectively positioned at two sides of the signal terminal pair 141*g*. Each terminal (141 or 142) comprises a second retaining portion 1401, a second contact portion 1402, a second positioning portion 1403 and a second tail portion 1404. Referring to FIG. 4, FIG. 6 and FIG. 8, in each terminal (141 or 142), the second retaining portion 1401 is retained in the corresponding terminal groove 113; the second contact portion 1402 extends from the second retaining portion 1401 and extends to the mating portion 112; the second positioning portion 1403 extends rearwards from the second retaining portion 1401; the second tail portion 1404 is connected to the second positioning portion 1403. The second positioning portion 1403 of each terminal (141 or 142) of the second group of terminals 14 may be received in the corresponding positioning groove 121 of the terminal positioning member 12.

Referring to FIG. 4, the spacing rib 122*b* extends between the two second positioning portions 1403 of the signal terminal pair 141*g* of the second group of terminals 14, the spacing rib 122*a* extends between the second positioning portion 1403 of the signal terminal 141 and the second positioning portion 1403 of the adjacent ground terminal 142 of the second group of terminals 14, the spacing rib 122*b* is longer than the spacing rib 122*a*; or in the spacing ribs 122*a* and 122*b* related to the second group of terminals 14, the spacing rib 122*b* is longer, and the spacing rib 122*a* is shorter. In some embodiments, a width of a longer portion 1222 of the spacing rib 122*b* relative to the spacing rib 122*a* is smaller than a width of the spacing rib 122*a* or a width of the other portions of the spacing rib 122*b*. Therefore, there are a larger exposed areas directly facing each other between the second positioning portion 1403 of the signal terminal pair 141*g* and the second positioning portion 1403 of the adjacent ground terminal 142 in design, thereby decreasing the signal crosstalk due to coupling between the terminals (141 or 142) of the second group of terminals 14, thus facilitating the high-rate transmission of the signals and the integrity of the signals, and meeting the requirements on lowering near-end crosstalk of the electrical connector 1 when the electrical connector 1 is under high-rate transmission.

In some embodiments, the second group of terminals 14 comprises seven terminals (141 and 142) which are divided into three ground terminals 142 and two groups of signal terminal pairs 141*g*. The seven terminals (141 and 142) are arranged side by side, the three ground terminals 142 may be respectively positioned between the two groups of signal terminal pairs 141*g* and at two outer sides of the two groups of signal terminal pairs 141*g*; or the three ground terminals 142 and the two groups of signal terminal pair 141*g* are staggered side by side, thereby making the two sides of each signal terminal pair 141*g* arranged with the ground terminal 142.

Referring to FIG. 4, the electrical connector 1 comprises a third group of terminals 15. Each terminal 151 of the third group of terminals 15 comprises a third retaining portion 1501, a third contact portion 1502, a third positioning portion 1503 and a third tail portion 1504. In each terminal 151, the third retaining portion 1501 is retained in the corresponding terminal groove 113. The third contact portion 1502 extends from the third retaining portion 1501 and extends to the mating portion 112. The third positioning portion 1503 extends rearwards from the third retaining portion 1501. The third tail portion 1504 is connected to the third positioning portion 1503. The third positioning portion 1503 of each terminal 151 of the third group of terminals 15 is received in the corresponding positioning groove 121 of the terminal positioning member 12. The spacing ribs 122*e* between adjacent two third retaining portions 1501 of the terminal 151 of the third group of terminals 15 are identical in length.

In some embodiments, the third group of terminals 15 comprises fifteen terminals 151 arranged side by side. In the fifteen terminals 151, contact portions 1502 of two terminals 151*a* further protrude forwards relative to contact portions 1502 of the other terminals 151 of the third group of terminals 15.

Referring to FIG. 3, in some embodiments, a height of the first positioning portion 1303 of the first group of terminals 13 is different from a height of the second positioning portion 1403 of the second group of terminals 14 and/or a height of the third positioning portion 1503 of the third group of terminals 15.

Referring to FIG. 4, the terminal positioning member 12 comprises a raised portion 123. The first positioning portions

1303 of the first group of terminals 13 are positioned on the raised portion 123, thereby making the height of the first positioning portion 1303 of the first group of terminals 13 higher than the height of the second positioning portion 1403 of the second group of terminals 14 or the height of the third positioning portion 1503 of the third group of terminals 15.

Referring to FIG. 4, in some embodiments, the first retaining portion 1301 of each terminal (131 or 132) of the first group of terminals 13 comprises at least an aperture 13011, however, the second retaining portion 1401 of each terminal (141 or 142) of the second group of terminals 14 and the third retaining portion 1501 of each terminal 151 of the third group of terminals 15 each do not comprise an aperture.

Figure 2:
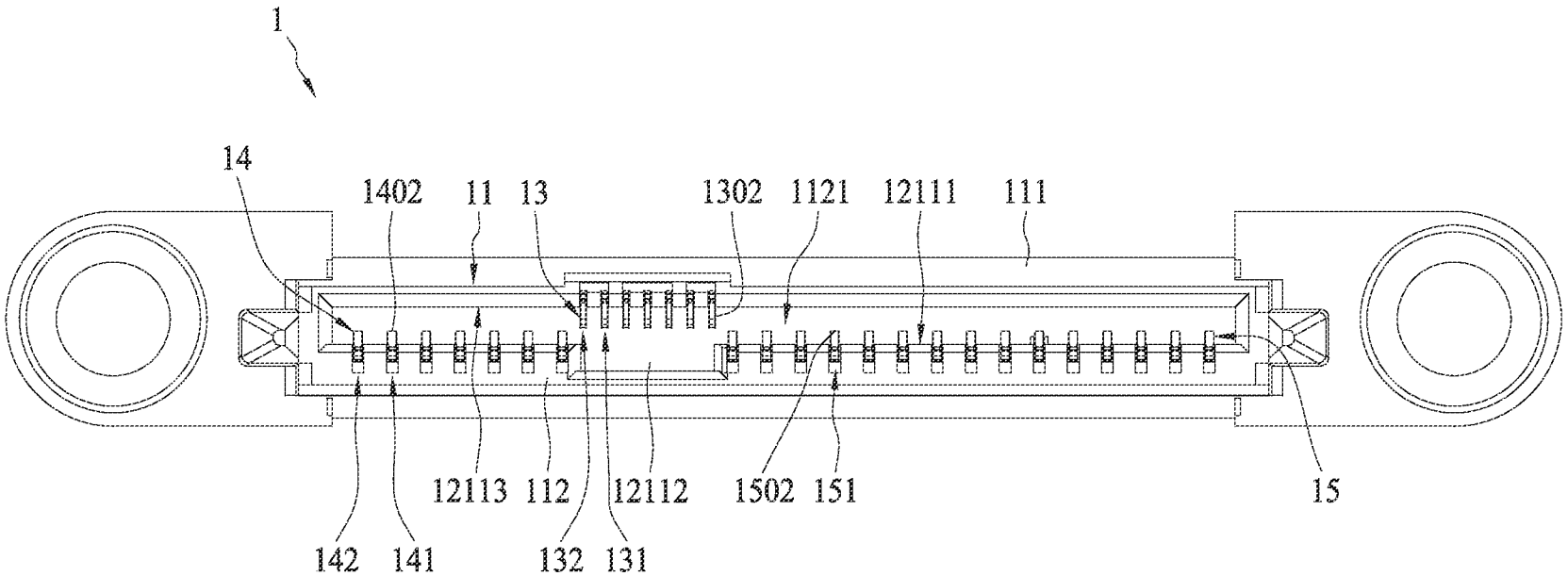
FIG. 2 is another schematic view illustrating the electrical connector of the embodiment of the present disclosure.

Referring to FIG. 2, in some embodiments, the mating portion 112 of the electrical connector 1 comprises a mating groove 1121. The second contact portion 1402 of each terminal (141 or 142) of the second group of terminals 14 and the third contact portion 1502 of each terminal 151 of the third group of terminals 15 extend along an inner wall surface 12111 of the mating groove 1121, the first contact portion 1302 of each terminal (131 or 132) of the first group of terminals 13 extends along another inner wall surface 12113, and the second contact portions 1402 of the terminals (141 and 142) of the second group of terminals 14 and the third contact portions 1502 of the terminal 151 of the third group of terminals 15 are spaced apart by a spacing region 12112. And the first contact portions 1302 of the terminals (131 and 132) of the first group of terminals 13 face the spacing region 12112.

In at least some embodiments, the electrical connector comprises a group of terminals, the two signal terminals of the signal terminal pair of the group of terminals is spaced apart by the longer spacing rib, the signal terminal and the ground terminal of the group of terminals are spaced apart by the shorter spacing rib, therefore the side edges positioned between the signal terminal and the adjacent ground terminal have larger exposed areas directly facing each other relative to the side edges positioned the two signal terminals, thereby decreasing the signal crosstalk due to coupling of the terminals of the group of terminals, thus facilitating the high-rate transmission of the signals and the integrity of the signals.

Technical contents and technical features of the present disclosure are disclosed as above, but person skilled in the art still may make various substitutions and modifications without departing from the spirit of the present disclosure based on the teaching and disclosure of the present disclosure. Therefore, the scope of the present disclosure should not be limited to the contents disclosed by the embodiments, but should include various substitutions and modifications, without departing the present disclosure, that are covered by the appended Claims of the present disclosure.

What is claimed is:

1. An electrical connector, comprising:

an elongated insulative body comprising a base portion and a mating portion extending forward from the base portion, the base portion of the insulative body being provided with a plurality of terminal grooves extended to the mating portion;

a terminal positioning member provided to a rear end of the base portion of the insulative body, the terminal positioning member comprising a plurality of positioning grooves and a plurality of spacing ribs positioned between the positioning grooves; and a first group of terminals respectively mounted in the terminal grooves of the insulative body, the first group of terminals comprising at least a signal terminal pair formed by two adjacent signal terminals and a plurality of ground terminals respectively provided at two sides of the signal terminal pair, each terminal of the first group of terminals comprising a first retaining portion retained in the corresponding terminal groove, a first contact portion extending from the first retaining portion and extending to the mating portion, a first positioning portion extending rearwards from the first retaining portion and a first tail portion;

the first positioning portions of the signal terminals and the ground terminals being received in the corresponding positioning grooves of the terminal positioning member;

in the spacing ribs related with the first group of terminals, the spacing rib positioned between the two first positioning portions of the signal terminal pair of the first group of terminals being longer, and the spacing rib positioned between the first positioning portion of the signal terminal and the first positioning portion of the adjacent ground terminal being shorter; and the shorter spacing rib positioned between the first positioning portion of the signal terminal and the first positioning portion of the adjacent ground terminal making side edges between of the first positioning portion of the signal terminal and the first positioning portion of the adjacent ground terminal having larger exposed areas directly facing each other relative to side edges between the two first positioning portions of the signal terminal pair.

2. The electrical connector according to claim 1, wherein the first group of terminals comprise three ground terminals and two groups of signal terminal pair, the three ground terminals and the two groups of signal terminal pair are staggered side by side.

3. The electrical connector according to claim 1, wherein the first retaining portion of each terminal of the first group of terminals comprises at least an aperture.

4. The electrical connector according to claim 2, wherein the electrical connector further comprises a second group of terminals;

the second group of terminals comprises at least a signal terminal pair formed by two adjacent signal terminals and a plurality of ground terminals respectively provided at two sides of the signal terminal pair of the second group of terminals;

each terminal of the second group of terminals comprises a second retaining portion retained in the corresponding terminal groove, a second contact portion extending from the second retaining portion and extending to the mating portion, a second positioning portion extending rearwards from the second retaining portion and a second tail portion, the second positioning portion of each terminal of the second group of terminals is received in the corresponding positioning groove of the terminal positioning member; and in the spacing ribs related with the second group of terminals, the spacing ribs positioned between the two second positioning portions of the signal terminal pair of the second group of terminals are longer relative to the spacing ribs positioned between the second positioning portion of the signal terminal and the second positioning portion of the adjacent ground terminal of the second group of terminals.

5. The electrical connector according to claim 4, wherein the second group of terminals comprise three ground terminals and two groups of signal terminal pair, the three ground terminals and the two groups of signal terminal pair of the second group of terminals are staggered side by side.

6. The electrical connector according to claim 5, wherein the electrical connector further comprises a third group of terminals;

each terminal of the third group of terminals comprises a third retaining portion retained in the corresponding terminal groove, a third contact portion extending from the third retaining portion and extending to the mating portion, a third positioning portion extending rearwards from the third retaining portion and a third tail portion, the third positioning portion of each terminal of the third group of terminals is received in the corresponding positioning groove of the terminal positioning member; and the spacing ribs positioned between the third positioning portions of the terminals of the third group of terminals are identical in length.

7. The electrical connector according to claim 6, wherein the third group of terminals comprise fifteen parallel terminals; in the fifteen terminals, the third contact portions of the two terminals further protrude rearwards than the other third contact portions of the third group of terminals.

8. The electrical connector according to claim 6, wherein a height of the first positioning portion of the first group of terminals is different from a height of the second positioning portion of the second group of terminals and a height of the third positioning portion of the third group of terminals.

9. The electrical connector according to claim 1, wherein the terminal positioning member comprises a raised portion, the first positioning portions of the first group of terminals are positioned on the raised portion.

10. The electrical connector according to claim 6, wherein the first retaining portion of each terminal of the first group of terminals comprises at least an aperture, the second retaining portion of each terminal of the second group of terminals and the third retaining portion of each terminal of the third group of terminals each do not comprise an aperture.

11. The electrical connector according to claim 1, wherein the terminal positioning member and the insulative body are separately manufactured, two sides of the terminal positioning member each are provided with a latching structure engaged on the insulative body.

12. The electrical connector according to claim 11, wherein the latching structure of the terminal positioning member comprises a latching hook and a guiding bar, the insulative body is provided with a guiding groove corresponding to the guiding bar and a latching portion correspondingly engaged with the latching hook.

13. The electrical connector according to claim 6, wherein the mating portion comprises a mating groove, the second group of terminals and the third group of terminals extend along an inner wall surface of the mating groove, the second group of terminals and the third group of terminals are spaced apart by a spacing region, the first group of terminals extend along another inner wall surface of the mating groove and face the spacing region.

* * * * *